US012668888B2

(12) United States Patent
Frischhut et al.

(10) Patent No.: US 12,668,888 B2
(45) Date of Patent: Jun. 30, 2026

(54) COMPOSITION FOR TIN OR TIN ALLOY ELECTROPLATING COMPRISING A PYRAZOLE-TYPE ANTIOXIDANT

(71) Applicant: BASF SE, Ludwigshafen Am Rhein (DE)

(72) Inventors: Sabine Frischhut, Ludwigshafen (DE); Jan Niclas Gorges, Ludwigshafen (DE); Soichi Watanabe, Ludwigshafen (DE); Marco Arnold, Ludwigshafen (DE)

(73) Assignee: BASF SE, Ludwigshafen Am Rhein (DE)

( * ) Notice: Subject to any disclaimer, the term of this patent is extended or adjusted under 35 U.S.C. 154(b) by 0 days.

(21) Appl. No.: 18/703,738

(22) PCT Filed: Nov. 11, 2022

(86) PCT No.: PCT/EP2022/081571
§ 371 (c)(1),
(2) Date: Apr. 23, 2024

(87) PCT Pub. No.: WO2023/088795
PCT Pub. Date: May 25, 2023

(65) Prior Publication Data

US 2025/0011961 A1 Jan. 9, 2025

(30) Foreign Application Priority Data

Nov. 22, 2021 (EP) ..... 21209548

(51) Int. Cl.
*C25D 3/30* (2006.01)
*C25D 3/32* (2006.01)
(Continued)

(52) U.S. Cl.
CPC ..... *C25D 3/32* (2013.01)

(58) Field of Classification Search
CPC ... C25D 3/30; C25D 3/32; C25D 3/60; C25D 5/00; C25D 5/02
(Continued)

(56) References Cited

U.S. PATENT DOCUMENTS 4,871,429 A 10/1989 Nobel et al.
2006/0096867 A1* 5/2006 Bokisa ..... C25D 3/56 205/253
(Continued)

FOREIGN PATENT DOCUMENTS

CN 102732918 A 10/2012
CN 107502927 A 12/2017
(Continued)

OTHER PUBLICATIONS

International Search Report for PCT/EP2022/081571 dated Feb. 7, 2023, 4 pages.
(Continued)

*Primary Examiner* — Edna Wong
(74) *Attorney, Agent, or Firm* — Armstrong Teasdale LLP

(57) ABSTRACT

Disclosed herein is an aqueous composition including tin ions, optionally alloy metal ions, and at least one antioxidant of formula X1a (X1a)

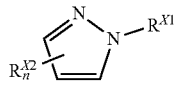

or of formula L1b (X1b)

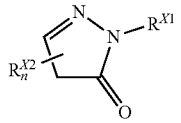

or of formula L1c (X1c)

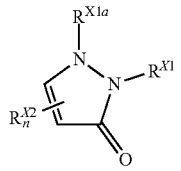

or of formula L1d (X1d)

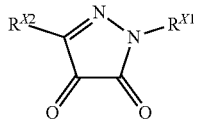

or of formula L1e (X1e)

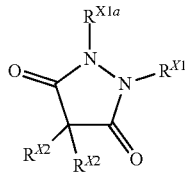

(Continued)

or the tautomeric forms of formulas X1b, X1c, X1d, and X1e, where no further metal ions are present in the composition besides tin ions and at least one of silver, indium, and bismuth ions; and where the composition does not include any reducing agents besides the compounds of formulas X1a to X1e.

18 Claims, No Drawings

(51) Int. Cl.
*C25D 3/60* (2006.01)
*C25D 5/00* (2006.01)
*C25D 5/02* (2006.01)

(58) Field of Classification Search
USPC ..... 205/252, 253, 254, 300, 302, 303, 304, 205/118, 123, 125
See application file for complete search history.

(56) References Cited

U.S. PATENT DOCUMENTS

| | | | |
|---|---|---|---|
| 2019/0368063 | A1 | 12/2019 | Yamaguchi et al. |
| 2021/0025070 | A1 | 1/2021 | Fritzsche et al. |

FOREIGN PATENT DOCUMENTS

| | | | |
|---|---|---|---|
| JP | 2001262391 | A | 9/2001 |
| KR | 101175062 | B1 | 8/2012 |
| TW | 201833391 | A | 9/2018 |
| WO | 2006053062 | A2 | 5/2006 |
| WO | 2017061443 | A1 | 4/2017 |
| WO | 2019201753 | A1 | 10/2019 |

OTHER PUBLICATIONS

Written Opinion for PCT/EP2022/081571 dated Feb. 7, 2023, 7 pages.

* cited by examiner

COMPOSITION FOR TIN OR TIN ALLOY ELECTROPLATING COMPRISING A PYRAZOLE-TYPE ANTIOXIDANT

CROSS-REFERENCE TO RELATED APPLICATIONS

This application is a U.S. National Phase Application of International Patent Application No. PCT/EP22/81571, filed Nov. 11, 2022, which claims priority to European Patent Application No. 21209548.3 filed Nov. 22, 2021, and each of which is hereby incorporated by reference herein.

BACKGROUND OF THE INVENTION

The invention relates to tin or tin alloy electroplating compositions comprising an antioxidant, their use and processes for tin or tin alloy electroplating.

Metals and metal-alloys are commercially important, particularly in the electronics industry where they are often used as electrical contacts, final finishes and solders.

Lead free solders, such as tin, tin-silver, tin-copper, tin-bismuth, tin-silver-copper, and others, are common metals used in solders. These solders are often deposited on semiconductor substrates by means of metal electroplating plating baths.

A typical tin plating solution comprises dissolved tin ions, water, an acid electrolyte such as methanesulfonic acid in an amount sufficient to impart conductivity to the bath, an antioxidant, and proprietary additives to improve the uniformity of the plating and the quality of the metal deposit in terms of surface roughness and void formation. Such additives usually include surfactants and grain refiners, among others.

Certain applications for lead-free solder plating present challenges in the electronics industry. For example, when used as a capping layer on copper pillars, a relatively small amount of lead-free solder, such as tin or tin-silver solder, is deposited on top of a copper pillar.

Tin is used in the plating composition in its 2+ oxidation state. Due to oxidation to dissolved $Sn^{2+}$ to $Sn^{4+}$ and the hydrolysis of $Sn^{4+}$ insoluble $SnO_2$ may be formed during electroplating and in particular during storage of the plating bath. The formation of insoluble tin not only wastes valuable tin metal and increases the operation cost, but also excessive tin mud in the plating solution may negatively interfere with the electroplating process. In order to reduce the generation of insolubly tin oxide in the tin plating solution, usually an antioxidant component is added to the bath.

U.S. Pat. No. 4,871,429 discloses an electrolyte for electroplating tin or tin-lead alloys which comprises a soluble divalent tin compound, a soluble alkyl or alkylol sulfonic acid in an amount sufficient to provide a solution having a pH less than about 3, at least one wetting agent, and a hydroxyphenyl compound in an amount sufficient to reduce or prevent the formation of tetravalent tin and tin-oxide sludge. Preferred hydroxyphenyl compounds include pyrocatechol, hydroquinone, resorcinol, phloroglucinol, pyrogallol, 3-amino phenol, or hydroquinone sulfuric acid ester.

WO2019/201753 A1 discloses compositions for tin and tin alloy electroplating that may contain one or more antioxidants, such as hydroquinone, and hydroxylated and/or alkoxylated aromatic compounds, including sulfonic acid derivatives of such aromatic compounds, and preferably are: hydroquinone; methylhydroquinone; resorcinol; catechol; 1,2,3-trihydroxybenzene; 1,2-dihydroxybenzene-4-sulfonic acid; 1,2-dihydroxybenzene-3, 5-disulfonic acid; 1,4-dihydroxybenzene-2-sulfonic acid; 1,4-dihydroxybenzene-2, 5-disulfonic acid; 2,4-dihyroxybenzene sulfonic acid, and p-Methoxyphenol.

CN 107502927 A discloses a methanesulfonic acid tin electroplating bath comprising a main antioxidant selected from one or more of phenol, o-diphenol, m-diphenol, p-diphenol and derivatives substituted by carboxyl, amino, nitro and sulfonic groups, and (2R,3S)-2-(3,4-dihydroxyphenyl)-3,4-dihydro-2H-benzopyran-3,5,7-triol as an auxiliary antioxidant.

KR 10 1175062 B1 discloses a lead-free solder tin-silver plating bath which comprises divalent tin ion, monovalent silver ion, a conductive salt, a silver ion complexing agent, a smoothing agent, and an antioxidant. Specifically mentioned antioxidants are catechol, hydroquinone, ascorbic acid, ascorbic acid salt, and 2-phenylenediamine.

CN102732918 A discloses a tin electroplating bath comprising tin ions and an antioxidant such as pyrazolone. The tin bath further comprises gold ions and a brightening agent.

JP2001262391 A discloses a tin electroplating bath comprising tin ions and 1, 3-dimethyl pyrazolone. The tin bath further comprises copper ions, silver ions and additives such a surfactant.

WO 2017/061443 A1 relates to tin or tin alloy coated copper powder for preparing a conductive paste containing such powder. For manufacturing such tin coated copper powder a tin electroless bath comprising tin ions and a reducing agent such as phosphoric acid compound, a borohydride compound, and a hydrazine derivative is disclosed. As a hydrazine derivative 3-methyl-5-pyrazolone is explicitly mentioned. However, any reducing agent that is capable of electrolessly reducing tin (II) to elemental tin would negatively interfere with the electroplating process and needs to be avoided.

US 2021/025070 A1 discloses a tin electroplating bath, and process thereof, for filling micrometer recessed features without substantially forming voids within the metal deposit, for using as contacts and solders in the electronic industry.

There is still a strong need for an antioxidant, which has an excellent long-term antioxidant effect and stability, shows good or even better solubility in aqueous media, is less toxic and does not interfere with the electroplating process. The electroplating composition should also show little discoloration during use.

Therefore, it is an object of the present invention to provide a tin or tin alloy electroplating antioxidant which has an excellent long-term antioxidant effect, stability, and little discoloration. It is another object of the invention to provide an antioxidant that shows good or even better solubility in aqueous media. It is yet another object of the invention to provide an antioxidant that is less toxic. It is yet another object of the invention to provide an antioxidant that does not interfere with the electroplating process, particularly allows depositing a substantially planar tin or tin alloy layer and filling features on the micrometer scale without substantially forming defects, such as but not limited to voids, with a tin or tin alloy electroplating bath. It should also not interfere with the electroplating process by electrolessly reducing any tin or tin alloy ions to the respective elemental metal.

SUMMARY OF THE INVENTION

The present invention provides an aqueous composition comprising tin ions, optionally alloy metal ions, and at least one antioxidant of formula X1a (X1a)

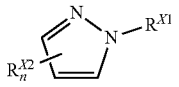

or of formula X1b (X1b)

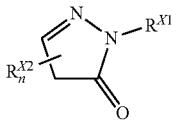

or of formula X1c (X1c)

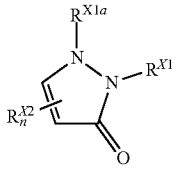

or of formula X1d (X1d)

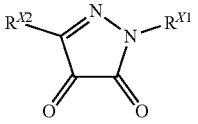

or of formula X1e (X1e)

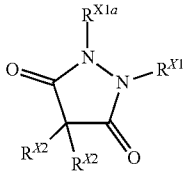

or the tautomeric forms of formulas X1a, X1b, X1c, X1d, and X1e, wherein $R^{X1}$, $R^{X1a}$ are independently selected from (a) H, and (b) $C_1$ to $C_6$ alkyl, $C_1$ to $C_6$ alkenyl, $C_5$ to $C_{12}$ aryl, $C_6$ to $C_{15}$ alkylaryl, $C_6$ to $C_{15}$ arylalkyl, all of which are unsubstituted or substituted by OH, $OR^{X3}$, —CO—$R^{X3}$, —CO—$OR^{X3}$, —$SO_2$—$OR^{X3}$, CN, halogen, or a combination thereof, with the proviso that if the antioxidant is of formula X1b then $R^{X1}$ is not $C_5$ to $C_{12}$ aryl or $C_6$ to $C_{15}$ alkylaryl;

$R^{X2}$ is selected from (a) H, OH, $OR^{X3}$, —CO—$R^{X3}$, —CO—$OR^{X3}$, —$SO_2$—$OR^{X3}$, and (b) $C_1$ to $C_6$ alkyl, $C_1$ to $C_6$ alkenyl, $C_5$ to $C_{12}$ aryl, $C_6$ to $C_{15}$ alkylaryl, $C_6$ to $C_{15}$ arylalkyl, all of which are unsubstituted or substituted by OH, $OR^{X3}$, —CO—$R^{X3}$, —CO—$OR^{X3}$, —$SO_2$—$OR^{X3}$, CN, halogen, or a combination thereof, wherein in formula X1a at least one of $R^{X2}$ is OH, with the proviso that if in formula X1a $R^{X1}$ is t-butyl then $R^{X2}{}_2$ is not $C_5$ to $C_{12}$ aryl or —CO—$R^{X3}$;

$R^{X3}$ is H or $C_1$ to $C_6$ alkyl; and n is the number of groups $R^{X2}$.

A further embodiment of the present invention is the use of the antioxidants as described herein in a bath for depositing tin or tin alloy containing layers, wherein the tin alloy containing layers comprise an alloy metal in an amount of 0.01 to 10% by weight.

Yet another embodiment of the present invention is a process for depositing a tin or tin alloy layer on a substrate by a) contacting a tin alloy electroplating bath comprising a composition as described herein with the substrate, and b) applying a current density to the substrate for a time sufficient to deposit a tin alloy layer onto the substrate.

The antioxidants according to the present invention can advantageously be used in bonding technologies such as but not limited to the manufacture of tin or tin alloy bumps of typically 1 to 200, preferably 3 to 100, most preferably 5 to 50 micrometers height and width for the bumping process, in circuit board technologies or in packaging processes for electronic circuits. In one particular embodiment, the substrate comprises micrometer sized features and the deposition is performed to fill the micrometer sized features, wherein the micrometer-sized features have a size from 1 to 200 micrometers, preferably 3 to 100 micrometers.

The antioxidants used in the plating compositions according to the present invention are less toxic compared to the usually used antioxidants like catechol. The antioxidants have an excellent long-term antioxidant effect, stability, and little discoloration. The antioxidant shows good or even better solubility in aqueous media compared to the state of the art antioxidants. Furthermore, the antioxidants do not interfere with the electroplating process, particularly allow depositing a substantially planar tin or tin alloy layer and filling features on the micrometer scale without substantially forming defects, such as but not limited to voids, with a tin or tin alloy electroplating bath.

DETAILED DESCRIPTION OF THE INVENTION

Antioxidants

The tin or tin alloy electroplating compositions according to the invention comprise at least one of the antioxidants according to formulas X1a to X1e:

(X1a)

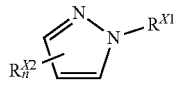

or of formula X1b (X1b)

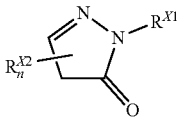

or of formula X1c (X1c)

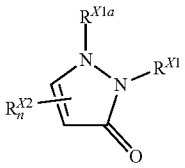

or of formula X1d (X1d)

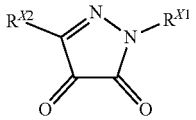

or of formula X1e (X1e)

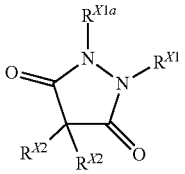

In one embodiment $R^{X1}$ and $R^{X1a}$ may be H. In another embodiment $R^{X1}$ and $R^{X1a}$ may be selected from $C_1$ to $C_6$ alkyl, $C_1$ to $C_6$ alkenyl, $C_5$ to $C_{12}$ aryl, $C_6$ to $C_{15}$ alkylaryl, $C_6$ to $C_{15}$ arylalkyl, all of which are unsubstituted or substituted by OH, $OR^{X3}$, —CO—$R^{X3}$, —CO—$OR^{X3}$, —$SO_2$—$OR^{X3}$, CN, halogen, or a combination thereof. It needs to be noted that if the antioxidant is of formula X1b then $R^{X1}$ must not be $C_5$ to $C_{12}$ aryl or $C_6$ to $C_{15}$ alkylaryl since otherwise they do not properly work as antioxidants. Preferably $R^{X1}$ is selected from (a) H, and (b) $C_1$ to $C_6$ alkyl, phenyl, $C_1$ to $C_4$ alkylphenyl, all of which are unsubstituted or substituted by —CO—$OR^{X3}$ or —$SO_2$—$OR^{X3}$. More preferably $R^{X1}$ is selected from methyl, ethyl, or butyl, particularly t-butyl.

In one embodiment $R^{X2}$ may be selected from H, OH, $OR^{X3}$, —CO—$R^{X3}$, —CO—$OR^{X3}$, and —$SO_2$—$OR^{X3}$. In another embodiment $R^{X2}$ may be selected from $C_1$ to $C_6$ alkyl, $C_1$ to $C_6$ alkenyl, $C_5$ to $C_{12}$ aryl, $C_6$ to $C_{15}$ alkylaryl, $C_6$ to $C_{15}$ arylalkyl, all of which are unsubstituted or substituted by OH, $OR^{X3}$, —CO—$R^{X3}$, —CO—$OR^{X3}$, —$SO_2$—$OR^{X3}$, CN, halogen, or a combination thereof. In formula X1a at least one of $R^{X2}$ must be OH. If in formula X1a $R^{X1}$ is t-butyl then $R^{X2}{}_2$ must not be $C_5$ to $C_{12}$ aryl or —CO—$R^{X3}$ since otherwise they do not work properly as antioxidants. If more than 1 substituent $R^{X2}$ is present, either $R^{X2}$ may be selected independently. Preferably $R^{X2}$ is selected from H, OH, $OR^{X3}$, —CO—$R^{X3}$, —CO—$OR^{X3}$, —$SO_2$—$OR^{X3}$; and $C_1$ to $C_4$ alkyl, phenyl, $C_1$ to $C_4$ alkylphenyl, all of which may be unsubstituted or substituted by OH, $OR^{X3}$, —CO—$R^{X3}$, —CO—$OR^{X3}$ or —$SO_2$—$OR^{X3}$. More preferably $R^{X2}$ may be selected from H, OH, —CO—$R^{X3}$, methyl, ethyl, 1-propyl, 2-propyl, 1-butyl, 2 butyl, t-butyl, and phenyl, preferably H, OH, methyl and ethyl, which may be unsubstituted or substituted by OH.

Generally, $R^{X3}$ may be H or $C_1$ to $C_6$ alkyl, preferably H or $C_1$ to $C_4$ alkyl, more preferably H or $C_1$ to $C_3$ alkyl, most preferably H, methyl or ethyl.

n is the number of groups $R^{X2}$ and is 3 in formulas X1a and X1b, and 2 in formula X1c. It should be noted that in formula X1b there are two substituents $R^{X2}$ in position 1.

As used herein, "alkyl" and "alkanediyl" mean a linear, branched or cyclic alkyl or alkanediyl group, respectively. As used herein, "aromatic" or "aryl" means a mono or bicyclic, carbocyclic aromatic group As used herein, "alkenyl" and "alkenediyl" mean a linear, branched or cyclic alkenyl or alkenediyl group, respectively. As used herein, "arylalkyl" means an alkyl group that is substituted by one or more aryl groups, particularly one or more phenyl groups, most particularly one phenyl group. As used herein, "alkylaryl" means an aryl group that is substituted by one or more $C_1$ to $C_6$ alkyl groups, particularly one or more $C_1$ to $C_4$ alkyl groups, more particularly one or more methyl, ethyl or propyl groups, most particularly one or two methyl or ethyl groups.

It needs to be noted that some of the lactam compounds of formulas X1a, X1b, X1c and X1d are in equilibrium with their tautomeric lactim forms, e.g.:

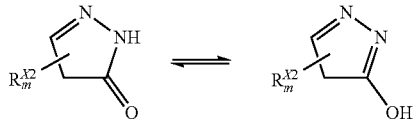

Even if it is only referred to the lactam form in the present application, their tautomeric lactim forms shall also be covered.

The positions of substituents $R^{X2}{}_n$ are numbered in the following way:

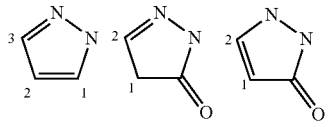

In a preferred embodiment the antioxidants are those of formula X1a, wherein $R^{X1}$ is selected from a $C_1$ to $C_4$ alkyl and either $R^{X2}{}_1$ or $R^{X2}{}_2$ are OH and the other $R^{X2}{}_1$, $R^{X2}{}_2$, and $R^{X2}{}_3$ are H, methyl ethyl, propyl or butyl, or —CO—$R^{X3}$.

Preferred antioxidants of formula X1a are:

| $R^{X1}$ | $R^{X2}{}_1$ * | $R^{X2}{}_2$ | $R^{X2}{}_3$ |
|---|---|---|---|
| methyl | methyl | OH | methyl |
| t-butyl | OH | methyl | methyl |
| t-butyl | methyl | OH | ethyl |
| methyl | methyl | OH | —CO—$CH_3$ |
| methyl | methyl | OH | phenyl |
| methyl | methyl | OH | ethyl |
| methyl | OH | H | methyl |

* the suffix of $R^{X2}$ indicates the position

Particularly preferred antioxidants of formula X1a are

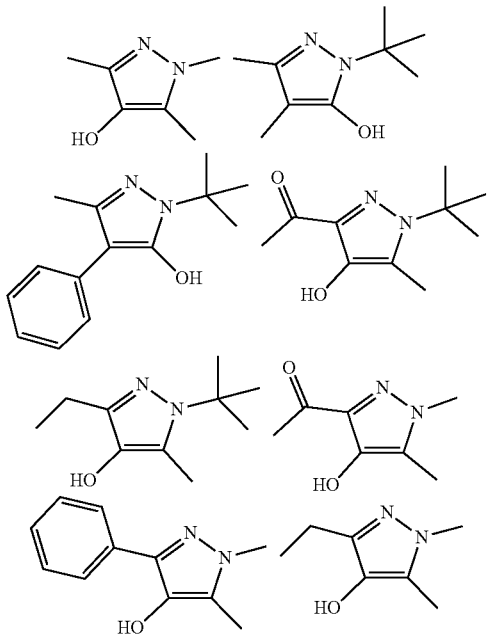

In another preferred embodiment the antioxidants are those of formula X1b, wherein $R^{X1}$ is selected from H and a $C_1$ to $C_4$ alkyl; the first $R^{X2}{}_1$ is H and the second $R^{X2}{}_1$ is selected from H, $C_1$ to $C_4$ alkyl, —$SO_3H$, COOH and $COCH_3$; and $R^{X2}{}_2$ is selected from H and a $C_1$ to $C_4$ alkyl.

Preferred antioxidants of formula X1b are

| $R^{X1}$ | $R^{X2}{}_1$ | $R^{X2}{}_2$ |
|---|---|---|
| H | H, H | H |
| H | H, H | methyl |
| methyl | H, H | methyl |
| H | —$SO_3H$; H | methyl |
| H | —COOH, H | H |
| H | —$COCH_3$, H | methyl |

Particularly preferred antioxidants of formula X1b are

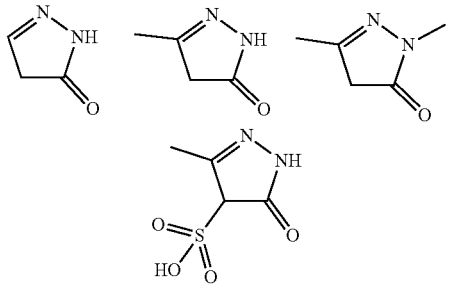

In another preferred embodiment the antioxidants are those of formula X1c, wherein $R^{X1}$ is selected from H and a $C_1$ to $C_4$ alkyl and phenyl; $R^{X1a}$ is selected from H and a $C_1$ to $C_4$ alkyl; the first $R^{X2}{}_1$ is H and the second $R^{X2}{}_1$ is selected from H, $C_1$ to $C_4$ alkyl, —$SO_3H$, COOH and $COCH_3$; and $R^{X2}{}_2$ is selected from H and $C_1$ to $C_4$ alkyl.

Preferred antioxidants of formula X1c are

| $R^{X1}$ | $R^{X1a}$ | $R^{X2}{}_1$ | $R^{X2}{}_2$ |
|---|---|---|---|
| phenyl | methyl | H | methyl |
| methyl | methyl | H | methyl |
| ethyl | H | ethyl | H |

Particularly preferred antioxidants of formula X1c are

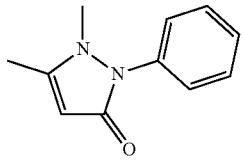

In another preferred embodiment the antioxidants are those of formula X1d, wherein $R^{X1}$ is selected from H and a $C_1$ to $C_4$ alkyl; and $R^{X2}$ is selected from H, $C_1$ to $C_4$ alkyl, —$SO_3H$, COOH and $COCH_3$.

Preferred antioxidants of formula X1d are

| $R^{X1}$ | $R^{X2}$ |
|---|---|
| methyl | methyl |
| Methyl | H |
| H | methyl |
| phenyl | H |
| Phenyl | Methyl |
| t-butyl | H |
| t-butyl | Methyl |
| methyl | Ethyl |
| Methyl | CO—CH3 |
| t-butyl | CO—CH3 |
| Phenyl | CO—CH3 |

In another preferred embodiment the antioxidants are those of formula X1e, wherein $R^{X1}$ is selected from H and a $C_1$ to $C_4$ alkyl and phenyl; $R^{X1a}$ is selected from H and a $C_1$ to $C_4$ alkyl; the first $R^{X2}{}_1$ is H and the second $R^{X2}{}_1$ is selected from H and $C_1$ to $C_4$ alkyl; the first $R^{X2}{}_1$ is H and the second $R^{X2}{}_1$ is selected from H and $C_1$ to $C_4$ alkyl, —$SO_3H$, COOH and $COCH_3$; and $R^{X2}{}_2$ is selected from H and a $C_1$ to $C_4$ alkyl.

Preferred antioxidants of formula X1e are

| $R^{X1}$ | $R^{X1a}$ | $R^{X2}$ |
|---|---|---|
| phenyl | H | H, H |
| t-butyl | H | H, H |
| methyl | H | H, H |
| phenyl | H | methyl, H |
| methyl | methyl | H, H |

A particularly preferred antioxidant of formula X1e is

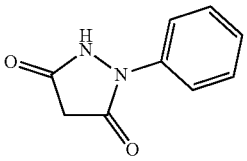

It will be appreciated by those skilled in the art that more than one antioxidant may be used but it is preferred to use only one antioxidant in the electroplating composition.

A large variety of other additives may typically be used in the bath to provide desired surface finishes for the plated tin or tin alloy bump. Usually more than one additive is used with each additive forming a desired function. Advantageously, the electroplating baths may contain one or more of levelers, surfactants, grain refiners, complexing agents in case of alloy deposition, antioxidants, and mixtures thereof. Most preferably the electroplating bath comprises a surfactant and optionally a grain refiner in addition to the leveling agent according to the present invention. Other additives may also be suitably used in the present electroplating baths.

Levelers

The electroplating composition may further comprise a leveling agent. It will be appreciated by those skilled in the art that more than one leveling agent may be used but it is preferred to use only one leveler.

Suitable leveling agents include, but are not limited to, polyaminoamide and derivatives thereof, polyalkanolamine and derivatives thereof, polyethylene imine and derivatives thereof, quaternized polyethylene imine, polyglycine, poly (allylamine), polyaniline, polyurea, polyacrylamide, poly (melamine-co-formaldehyde), reaction products of amines with epichlorohydrin, reaction products of an amine, epichlorohydrin, and polyalkylene oxide, reaction products of an amine with a polyepoxide, polyvinylpyridine, polyvinylimidazole, polyvinylpyrrolidone, or copolymers thereof, nigrosines, pentamethyl-para-rosaniline hydrohalide, hexamethyl-pararosaniline hydrohalide, or compounds containing a functional group of the formula N—R—S, where R is a substituted alkyl, unsubstituted alkyl, substituted aryl or unsubstituted aryl. Typically, the alkyl groups are $C_1$-$C_6$ alkyl and preferably $C_1$-$C_4$ alkyl. In general, the aryl groups include $C_6$-$C_{20}$ aryl, preferably $C_6$-$C_{12}$ aryl. Such aryl groups may further include heteroatoms, such as sulfur, nitrogen and oxygen. It is preferred that the aryl group is phenyl or napthyl. The compounds containing a functional group of the formula N—R—S are generally known, are generally commercially available and may be used without further purification.

In such compounds containing the N—R—S functional group, the sulfur ("S") and/or the nitrogen ("N") may be attached to such compounds with single or double bonds. When the sulfur is attached to such compounds with a single bond, the sulfur will have another substituent group, such as but not limited to hydrogen, $C_1$-$C_{12}$ alkyl, $C_2$-$C_{12}$ alkenyl, $C_6$-$C_{20}$ aryl, $C_1$-$C_{12}$ alkylthio, $C_2$-$C_{12}$ alkenylthio, $C_6$-$C_{20}$ arylthio and the like. Likewise, the nitrogen will have one or more substituent groups, such as but not limited to hydrogen, $C_1$-$C_{12}$ alkyl, $C_2$-$C_{12}$ alkenyl, $C_7$-$C_{10}$ aryl, and the like. The N—R—S functional group may be acyclic or cyclic. Compounds containing cyclic N—R—S functional groups include those having either the nitrogen or the sulfur or both the nitrogen and the sulfur within the ring system.

Further leveling agents are trialkanolamine condensates as described in WO 2010/069810 or.

In a preferred embodiment fluorinated α,β-unsaturated carbonyl compound of formula L1a may be used as levelers:

(L1a)

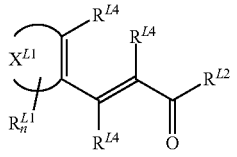

wherein $R^{L1}$ is, for each group $R^{L1}{}_n$ independently, selected from —F, a linear or branched $C_1$ or $C_2$ fluorinated $C_1$ to $C_6$ alkyl;

$R^{L2}$ is a $C_1$ to $C_6$ alkyl, $C_1$ to $C_6$ alkenyl, $C_5$ to $C_{12}$ aryl, $C_6$ to $C_{15}$ alkylaryl, $C_6$ to $C_{15}$ arylalkyl, all of which may be substituted by CN, OH, $C_1$ to $C_6$ alkoxy or halogen, particularly F;

$R^{L3}$ is selected from H, $C_1$ to $C_6$ alkyl, $C_1$ to $C_6$ alkenyl, $C_1$ to $C_6$ alkoxy or halogen, Cl, CN, and OH, preferably $R^{L1}$ or H;

$R^{L4}$ is $R^{L1}$ or $R^{L3}$;

$X^{L1}$ is (a) a divalent group selected from (i) a $C_3$ to $C_5$ alkanediyl, (ii) a $C_3$ to $C_5$ alkenediyl, or (b) forms, together with the adjacent C═C double bond, a $C_5$ to $C_{12}$ aromatic ring system; and n is the number of groups $R^{L1}$ selected from 1, 2 or 3, preferably 1 or 2, most preferably 1.

As used herein "fluorinated in $C_1$ or $C_2$ position" means that there is at least one, preferably two F substitution in the $C_1$ or in the $C_2$ position of the alkyl group.

Preferably $R^{L1}$ may be selected from —F, —$CR^{L3}{}_2F$, —$CR^{L3}F_2$, —$CF_3$, —$CFR^{L3}$—$CR^{L3}{}_3$, —$CF_2$—$CR^{L3}{}_3$, —$CF_2$—$CFR^{L3}{}_2$—$CF_2$—$CF_2R^{L3}$, and —$CF_2$—$CF_3$, wherein $R^{L3}$ is selected from H and $C_1$ to $C_6$ alkyl. Particularly preferable groups $R^{L1}$ may be —F or perfluorinated $C_1$ to $C_4$ alkyl, particularly —$CF_3$. Different groups $R^{L1}$ may be used for either specific substituent $R^{L1}{}_n$, i.e. for $R^{L1}{}_1$, $R^{L1}{}_2$, and $R^{L1}{}_3$ if more than one substituent $R^{L1}$ is present.

Further specific fluorinated α,β-unsaturated carbonyl compound of formula L1a are described in unpublished European Patent application No., which are incorporated herein by reference.

In general, the total amount of leveling agents in the electroplating bath is from 0.5 ppm to 10000 ppm based on the total weight of the plating bath. The leveling agents according to the present invention are typically used in a total amount of from about 100 ppm to about 10000 ppm based on the total weight of the plating bath, although greater or lesser amounts may be used.

Surfactants

One or more nonionic surfactants may be used in the present compositions. Typically, the nonionic surfactants have an average molecular weight from 200 to 100,000, preferably from 500 to 50,000, more preferably from 500 to 25,000, and yet more preferably from 750 to 15,000. Such nonionic surfactants are typically present in the electrolyte compositions in a concentration from 1 to 10,000 ppm, based on the weight of the composition, and preferably from 5 to 10,000 ppm. Preferred alkylene oxide compounds include polyalkylene glycols, such as but not limited to alkylene oxide addition products of an organic compound having at least one hydroxy group and 20 carbon atoms or less and tetrafunctional polyethers derived from the addition of different alkylene oxides to low molecular weight polyamine compounds.

Preferred polyalkylene glycols are polyethylene glycol and polypropylene glycol. Such polyalkylene glycols are generally commercially available from a variety of sources and may be used without further purification. Capped polyalkylene glycols where one or more of the terminal hydrogens are replaced with a hydrocarbyl group may also be suitably used. Examples of suitable polyalkylene glycols are those of the formula R—O—$(CXYCX'Y'O)_n$R' where R and R' are independently chosen from H, $C_2$-$C_{20}$ alkyl group and $C_6$-$C_{20}$ aryl group; each of X, Y, X and Y' is independently selected from hydrogen, alkyl such as methyl, ethyl or propyl, aryl such as phenyl, or aralkyl such as benzyl; and n is an integer from 5 to 100,000. Typically, one or more of X, Y, X' and Y' is hydrogen.

Suitable EO/PO copolymers generally have a weight ratio of EO:PO of from 10:90 to 90:10, and preferably from 10:90 to 80:20. Such EO/PO copolymers preferably have an average molecular weight of from 750 to 15,000. Such EO/PO copolymers are available from a variety of sources, such as those available from BASF under the tradename "PLURONIC".

Suitable alkylene oxide condensation products of an organic compound having at least one hydroxy group and 20 carbon atoms or less include those having an aliphatic hydrocarbon from one to seven carbon atoms, an unsubstituted aromatic compound or an alkylated aromatic compound having six carbons or less in the alkyl moiety, such as those disclosed in U.S. Pat. No. 5,174,887. The aliphatic alcohols may be saturated or unsaturated. Suitable aromatic compounds are those having up to two aromatic rings. The aromatic alcohols have up to 20 carbon atoms prior to derivatization with ethylene oxide. Such aliphatic and aromatic alcohols may be further substituted, such as with sulfate or sulfonate groups.

Grain Refiners

The tin or tin alloy electroplating bath may further contain grain refiners that are different from the levelers according to the invention. Grain refiners may be chosen from a compound of formula G1 or G2

(G1)

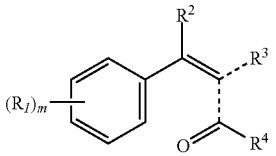

(G2)

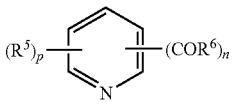

wherein each $R^1$ is independently $C_1$ to $C_6$ alkyl, $C_1$ to $C_6$ alkoxy, hydroxy, or halogen; $R^2$ and $R^3$ are independently selected from H and $C_1$ to $C_6$ alkyl; $R^4$ is H, OH, $C_1$ to $C_6$ alkyl or $C_1$ to $C_6$ alkoxy; m is an integer from 0 to 2; each $R^5$ is independently $C_1$ to $C_6$ alkyl; each $R^6$ is independently chosen from H, OH, $C_1$ to $C_6$ alkyl, or $C_1$ $C_6$ alkoxy; n is 1 or 2; and p is 0, 1 or 2.

Preferably, each $R^1$ is independently $C_1$ to $C_6$ alkyl, $C_1$ to $C_3$ alkoxy, or hydroxy, and more preferably $C_1$ to $C_4$ alkyl, $C_1$ to $C_2$ alkoxy, or hydroxy. It is preferred that $R^2$ and $R^3$ are independently chosen from H and $C_1$ to $C_3$ alkyl, and more preferably H and methyl. Preferably, $R^4$ is H, OH, $C^1$ to $C^4$ alkyl or $C_1$ to $C_4$ alkoxy, and more preferably H, OH, or $C_1$ to $C_4$ alkyl. It is preferred that $R^5$ is $C_1$ to $C_4$ alkyl, and more preferably $C_1$ to $C_3$ alkyl. Each $R^6$ is preferably chosen from H, OH, or $C_1$ to $C_6$ alkyl, more preferably H, OH, or $C_1$ to $C_3$ alkyl, and yet more preferably H or OH. It is preferred that m is 0 or 1, and more preferably m is 0. Preferably, n is 1. It is preferred that p is 0 or 1, and more preferably p is 0. A mixture of first grain refiners may be used, such as two different grain refiners of formula 1, 2 different grain refiners of formula 2, or a mixture of a grain refiner of formula 1 and a grain refiner of formula 2.

Exemplary compounds useful as such grain refiners include, but are not limited to, cinnamic acid, cinnamaldehyde, benzylidene acetone, picolinic acid, pyridinedicarboxylic acid, pyridinecarboxaldehyde, pyridinedicarboxaldehyde, or mixtures thereof. Preferred grain refiners include benzalacetone, 4-methoxy benzaldehyde, benzylpyridin-3-carboxylate, and 1,10-phenantroline.

Further grain refiners may be chosen from an α,β-unsaturated aliphatic carbonyl compound. Suitable α,β-unsaturated aliphatic carbonyl compound include, but are not limited to, α,β-unsaturated carboxylic acids, α,β-unsaturated carboxylic acid esters, α,β-unsaturated amides, and α,β-unsaturated aldehydes. Preferably, such grain refiners are chosen from α,β-unsaturated carboxylic acids, α,β-unsaturated carboxylic acid esters, and α,β-unsaturated aldehydes, and more preferably α,β-unsaturated carboxylic acids, and α,β-unsaturated aldehydes. Exemplary α,β-unsaturated aliphatic carbonyl compounds include (meth) acrylic acid, crotonic acid, C to C6 alkyl meth)acrylate, (meth)acrylamide, $C_1$ to $C_6$ alkyl crotonate, crotonamide, crotonaldehyde, (meth)acrolein, or mixtures thereof. Preferred α,β-unsaturated aliphatic carbonyl compounds are (meth)acrylic acid, crotonic acid, crotonaldehyde, (meth) acrylaldehyde or mixtures thereof.

Grain refiners may be present in the plating baths of the invention in an amount of 0.0001 to 0.045 g/l. Preferably, the grain refiners are present in an amount of 0.0001 to 0.04 g/l, more preferably in an amount of 0.0001 to 0.035 g/l, and yet more preferably from 0.0001 to 0.03 g/l. Compounds useful as the first grain refiners are generally commercially available from a variety of sources and may be used as is or may be further purified.

The present compositions may optionally include further additives, such as antioxidants, organic solvents, complexing agents, and mixtures thereof. While additional levelers may be used in the present plating baths, it is preferred that the plating baths comprise only the levelers according to the present invention.

Further Antioxidants

Additional antioxidants may optionally be added to the present composition to assist in keeping the tin in a soluble, divalent state. However, it is preferred not to use any further antioxidants besides those described above. Therefor, in a preferred embodiment the electroplating composition does not comprise any antioxidants or reducing agents besides those of formulas X1a to X1e. If used, exemplary further antioxidants include, but are not limited to, hydroquinone, and hydroxylated and/or alkoxylated aromatic compounds, including sulfonic acid derivatives of such aromatic compounds, and preferably are: hydroquinone; methylhydroquinone; resorcinol; catechol; 1,2,3-trihydroxybenzene; 1,2-dihydroxybenzene-4-sulfonic acid; 1,2-dihydroxy-benzene-3, 5-disulfonic acid; 1,4-dihydroxybenzene-2-sulfonic acid; 1,4-dihydroxybenzene-2, 5-disulfonic acid; 2,4-dihyroxybenzene sulfonic acid, and p-Methoxyphenol. Such antioxidants are disclosed in U.S. Pat. No. 4,871,429. Other suitable antioxidants include, but are not limited to, vanadium compounds, such as vanadylacetylacetonate, vanadium triacetylacetonate, vanadium halides, vanadium oxyhalides, vanadium alkoxides and vanadyl alkoxides. The concentration of such reducing agent is well known to those skilled in the art, but is typically in the range of from 0.1 to 10 g/l, and preferably from 1 to 5 g/l. Such antioxidants are generally commercially available from a variety of sources. It is particularly preferred to use the prescribed antioxidants in pure tin electroplating compositions.

Complexing Agents

The tin or tin alloy electroplating bath may further contain complexing agents for complexing tin and/or any other metal present in the composition. A typical complexing agent is 3,6-Dithia-1,8-octanediol. Further useful complexing agents are described in WO 2019/185 468 and unpublished international patent application No. PCT/EP2020/075 080.

Typical complexing agents are polyoxy monocarboxylic acids, polycarboxylic acids, aminocarboxylic acids, lactone compounds, and salts thereof.

Other complexing agents are organic thiocompounds like thiourea, thiols or thioethers as disclosed in U.S. Pat. No. 7,628,903, JP 4296358 B2, EP 0854206 A and U.S. Pat. No. 8,980,077 B2.

Electrolyte

The composition comprises tin and optionally alloy metal ions.

In general, as used herein "aqueous" means that the present electroplating compositions comprises a solvent comprising at least 50% of water. Preferably, "aqueous" means that the major part of the composition is water, more preferably 90% of the solvent is water, most preferably the solvent essentially consists of water. Any type of water may be used, such as distilled, deinonized or tap.

Tin

The tin ion source may be any compound capable of releasing metal ions to be deposited in the electroplating bath in sufficient amount, i.e is at least partially soluble in the electroplating bath. It is preferred that the metal ion source is soluble in the plating bath. Suitable metal ion sources are metal salts and include, but are not limited to, metal sulfates, metal halides, metal acetates, metal nitrates, metal fluoroborates, metal alkylsulfonates, metal arylsulfonates, metal sulfamates, metal gluconates and the like.

The metal ion source may be used in the present invention in any amount that provides sufficient metal ions for electroplating on a substrate. When the metal is solely tin, the tin salt is typically present in an amount in the range of from about 1 to about 300 g/l of plating solution. In one embodiment no further metals are present besides tin.

Alloying Metals

Optionally, the plating baths according to the invention may contain one or more alloying metal ions. Suitable alloying metals include, without limitation, silver, gold, copper, bismuth, indium, zinc, antimony, manganese and mixtures thereof. Preferred alloying metals are silver, copper, bismuth, indium, and mixtures thereof, and more preferably silver, bismuth, and indium, most preferably silver. It is preferred that the present compositions are free of lead. In one embodiment no further metals are present besides tin and at least one of silver, indium, and bismuth, preferably the only metals present in the composition are tin and at least one of silver, indium, and bismuth. Most preferably the only alloy metal consists of silver ions, i.e. the only metals present in the composition are tin and silver.

Any bath-soluble salt of the alloying metal may suitably be used as the source of alloying metal ions. Examples of such alloying metal salts include, but are not limited to: metal oxides; metal halides; metal fluoroborate; metal sulfates; metal alkanesulfonates such as metal methanesulfonate, metal ethanesulfonate and metal propanesulfonate; metal arylsulfonates such as metal phenylsulfonate, metal toluenesulfonate, and metal phenolsulfonate; metal carboxylates such as metal gluconate and metal acetate; and the like. Preferred alloying metal salts are metal sulfates; metal alkanesulfonates; and metal arylsulfonates. When one alloying metal is added to the present compositions, a binary alloy deposit is achieved. When 2, 3 or more different alloying metals are added to the present compositions, tertiary, quaternary or higher order alloy deposits are achieved. The amount of such alloying metal used in the present compositions will depend upon the particular tin-alloy desired. The selection of such amounts of alloying metals is within the ability of those skilled in the art. It will be appreciated by those skilled in the art that when certain alloying metals, such as silver, are used, an additional complexing agent may be required. Such complexing agents (or complexers) are well-known in the art and may be used in any suitable amount.

The present electroplating compositions are suitable for depositing a tin-containing layer, which may be a pure tin layer or a tin-alloy layer. Exemplary tin-alloy layers include, without limitation, tin-silver, tin-copper, tin-indium, tin-bismuth, tin-silver-copper, tin-silver-copper-antimony, tin-silver-copper-manganese, tin-silver-bismuth, tin-silver-indium, tin-silver-zinc-copper, and tin-silver-indium-bismuth. Preferably, the present electroplating compositions deposit pure tin, tin-silver, tin-silver-copper, tin-silver-bismuth, tin-silver-indium, and tin-silver-indium-bismuth, and more preferably pure tin, tin-silver or tin-copper.

Alloys deposited from the present electroplating bath contain an amount of tin ranging from 0.01 to 99.99 wt %, and an amount of one or more alloying metals ranging from 99.99 to 0.01 wt %, based on the weight of the alloy, as measured by either atomic adsorption spectroscopy (AAS), X-ray fluorescence (XRF), inductively coupled plasma (ICP) or differential scanning calorimetry (DSC). Preferably, the tin-silver alloys deposited using the present invention contain from 90 to 99.99 wt % tin and 0.01 to 10 wt % of silver and any other alloying metal. More preferably, the tin-silver alloy deposits contain from 95 to 99.9 wt % tin and 0.1 to 5 wt % of silver and any other alloying metal. Tin-silver alloy is the preferred tin-alloy deposit, and preferably contains from 90 to 99.9 wt % tin and from 10 to 0.1 wt % silver. More preferably, the tin-silver alloy deposits contain from 95 to 99.9 wt % tin and from 5 to 0.1 wt % silver. For many applications, the eutectic composition of an alloy may be used. Alloys deposited according to the present invention are substantially free of lead, that is, they contain 1 wt % lead, more preferably below 0.5 wt %, and yet more preferably below 0.2 wt %, and still more preferably are free of lead.

Bath

In general, besides the metal ion source and at least one of the leveling agents according to the invention the present metal electroplating compositions preferably include electrolyte, i. e. acidic or alkaline electrolyte, one or more sources of metal ions, optionally halide ions, and optionally other additives like surfactants and grain refiners. Such baths are typically aqueous. The water may be present in a wide range of amounts. Any type of water may be used, such as distilled, deionized or tap.

Preferably, the plating baths of the invention are acidic, that is, they have a pH below 7. Typically, the pH of the tin or tin alloy electroplating composition is below 4, preferably below 3, most preferably below 2.

The electroplating baths of the present invention may be prepared by combining the components in any order. It is preferred that the inorganic components such as metal salts, water, electrolyte and optional halide ion source, are first added to the bath vessel followed by the organic components such as surfactants, grain refiners, levelers and the like.

Typically, the plating baths of the present invention may be used at any temperature from 10 to 65 degrees C. or higher. It is preferred that the temperature of the plating baths is from 10 to 35 degrees C. and more preferably from 15 degrees to 30 degrees C.

Suitable electrolytes include such as, but not limited to, sulfuric acid, acetic acid, fluoroboric acid, alkylsulfonic acids such as methanesulfonic acid, ethanesulfonic acid, propanesulfonic acid and trifluoromethane sulfonic acid, arylsulfonic acids such as phenyl sulfonic acid and toluenesulfonic acid, sulfamic acid, hydrochloric acid, phosphoric acid, tetraalkylammonium hydroxide, preferably tetramethylammonium hydroxide, sodium hydroxide, potassium hydroxide and the like. Acids are typically present in an amount in the range of from about 1 to about 300 g/l.

In one embodiment the at least one additive comprises a counterion $Y^{o-}$ selected from chloride, sulfate or acetate. wherein o is a positive integer.

Such electrolytes may optionally contain a source of halide ions, such as chloride ions as in tin chloride or hydrochloric acid. A wide range of halide ion concentrations may be used in the present invention such as from about 0 to about 500 ppm. Typically, the halide ion concentration is in the range of from about 10 to about 100 ppm based on the plating bath. It is preferred that the electrolyte is sulfuric acid or methanesulfonic acid, and preferably a mixture of sulfuric acid or methanesulfonic acid and a source of chloride ions. The acids and sources of halide ions useful in the present invention are generally commercially available and may be used without further purification.

Application

The plating compositions of the present invention are useful in various plating methods where a tin-containing layer is desired, and particularly for depositing a tin-containing solder layer on a semiconductor wafer comprising a plurality of conductive bonding features. Plating methods include, but are not limited to, horizontal or vertical wafer plating, barrel plating, rack plating, high speed plating such as reel-to-reel and jet plating, and rackless plating, and preferably horizontal or vertical wafer plating. A wide variety of substrates may be plated with a tin-containing deposit according to the present invention. Substrates to be plated are conductive and may comprise copper, copper alloys, nickel, nickel alloys, nickel-iron containing materials. Such substrates may be in the form of electronic components such as (a) lead frames, connectors, chip capacitors, chip resistors, and semiconductor packages, (b) plastics such as circuit boards, and (c) semiconductor wafers. Preferably the substrates are semiconductor wafers. Accordingly, the present invention also provides a method of depositing a tin-containing layer on a semiconductor wafer comprising: providing a semiconductor wafer comprising a plurality of conductive bonding features; contacting the semiconductor wafer with the composition described above; and applying sufficient current density to deposit a tin-containing layer on the conductive bonding features. Preferably, the bonding features comprise copper, which may be in the form of a pure copper layer, a copper alloy layer, or any interconnect structure comprising copper. Copper pillars are one preferred conductive bonding feature. Optionally, the copper pillars may comprise a top metal layer, such as a nickel layer. When the conductive bonding features have a top metal layer, then the tin or tin alloy solder layer is deposited on the top metal layer of the bonding feature. Conductive bonding features, such as bonding pads, copper pillars, and the like, are well-known in the art, such as described in U.S. Pat. No. 7,781,325, US 2008/0054459 A, US 2008/0296761 A, and US 2006/0094226 A.

Process

One embodiment of the present invention is the use of an antioxidant of formulas X1a, X1b, X1c, X1d, or X1e in a bath for depositing tin or tin alloy containing layers, wherein the tin alloy containing layers comprise an alloy metal selected from silver, copper, indium, and bismuth in an amount of 0.01 to 10% by weight. Preferably the deposited tin alloy layer has an alloy metal content of 0.1 to 5% by weight.

Another embodiment of the present invention is a

A process for depositing a tin or tin alloy layer on a substrate by a) contacting a tin alloy electroplating bath comprising a composition as described herein with the substrate, and b) applying a current density to the substrate for a time sufficient to deposit the tin or tin alloy layer onto the substrate.

As used herein, "recessed feature" means a via, trench or any other opening in the substrate, particularly openings for depositing solder bumps. As used herein, "aperture size" means the shortest distance in the opening of the recessed feature.

Preferably the substrate comprises recessed features having an aperture size from 1 to 1000 micrometers and the deposition is performed to at least partially fill the micrometer sized recessed features. Most preferably the recessed features have an aperture size from 1 to 200 micrometers, preferably 3 to 100 micrometers.

In general, when the present invention is used to deposit tin or tin alloys on a substrate the plating baths are agitated during use. Preferably a tin alloy is deposited and the alloy metal content of the deposited tin alloy is from 0.01 to 10% by weight. Any suitable agitation method may be used with the present invention and such methods are well-known in the art. Suitable agitation methods include, but are not limited to, inert gas or air sparging, work piece agitation, impingement and the like. Such methods are known to those skilled in the art. When the present invention is used to plate an integrated circuit substrate, such as a wafer, the wafer may be rotated such as from 1 to 150 RPM and the plating solution contacts the rotating wafer, such as by pumping or spraying. In the alternative, the wafer need not be rotated where the flow of the plating bath is sufficient to provide the desired metal deposit.

The tin or tin alloy is deposited in recesses according to the present invention without substantially forming voids within the metal deposit. By the term "without substantially forming voids", it is meant that there are no voids in the metal deposit which are bigger than 1000 nm, preferably 500 nm, most preferably 100 nm.

Plating equipment for plating semiconductor substrates are well known. Plating equipment comprises an electroplating tank which holds tin or tin alloy electrolyte and which is made of a suitable material such as plastic or other material inert to the electrolytic plating solution. The tank may be cylindrical, especially for wafer plating. A cathode is horizontally disposed at the upper part of tank and may be any type substrate such as a silicon wafer having openings.

These additives can be used with soluble and insoluble anodes in the presence or absence of a membrane or membranes separating the catholyte from the anolyte.

The cathode substrate and anode are electrically connected by wiring and, respectively, to a power supply. The cathode substrate for direct or pulse current has a net negative charge so that the metal ions in the solution are reduced at the cathode substrate forming plated metal on the cathode surface. An oxidation reaction takes place at the anode. The cathode and anode may be horizontally or vertically disposed in the tank.

In general, when preparing tin or tin alloy bumps, a photoresist layer is applied to a semiconductor wafer, followed by standard photolithographic exposure and development techniques to form a patterned photoresist layer (or plating mask) having openings or vias therein. The dimensions of the plating mask (thickness of the plating mask and the size of the openings in the pattern) defines the size and location of the tin or tin alloy layer deposited over the I/O pad and UBM.

All percent, ppm or comparable values refer to the weight with respect to the total weight of the respective composition except where otherwise indicated. All cited documents are incorporated herein by reference.

The following examples shall further illustrate the present invention without restricting the scope of this invention.

EXAMPLES

Nine antioxidants were tested. Antioxidants 1 to 6 are commercially available. Antioxidant 7 was synthesized according to Organic and Bio-Organic Chemistry (1985), (1), 81-6.

Synthesis of Antioxidants 8 and 9:

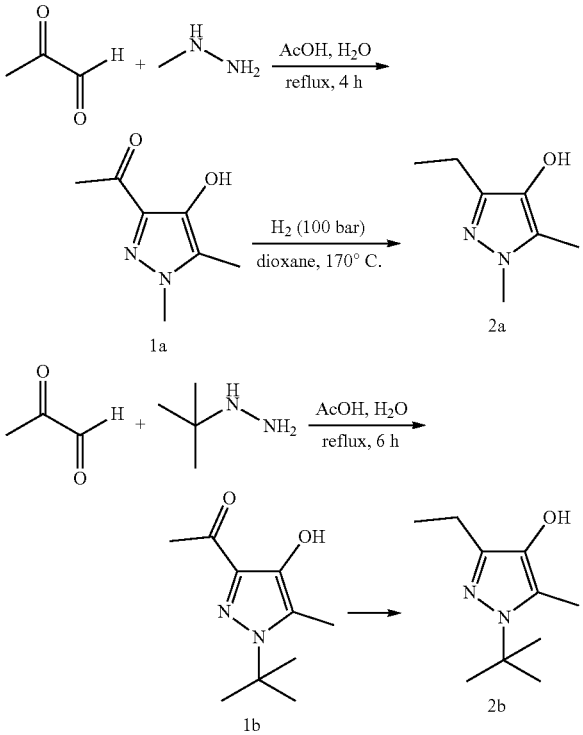

1-(4-hydroxy-1,5-dimethyl-pyrazol-3-yl)ethenone (1a)

In analogy to literature procedures[1,2] to a solution of methylhydrazine (24 g, 0.511 mol) and acetic acid (44 g, 0.734 mol) in water (100 mL) was added methylglyoxal (40% aqueous, 529 g, 2.94 mol) under cooling (8-12° C.). After completion of addition, the reaction mixture was heated to reflux for 4 hours. The mixture was cooled to room temperature and extracted four times with 1.5 L ethyl acetate. The combined organic layer was dried (Na2SO4) and the solvent was removed in vacuo. The crude product was purified using column chromatography (silica column, cyclohexane/ethyl acetate gradient). The product was isolated as a pale yellow solid (21 g, 0.133 mol, 26% yield).

1-(1-tert-butyl-4-hydroxy-5-methyl-pyrazol-3-yl) ethenone (1b)

To a solution of tert-butylhydrazine hydrochloride (24 g, 0.189 mol) in water (220 mL), methylglyoxal (40% aqueous, 136 g, 0.754 mol) and acetic acid (17 g (0.283 mol) were added subsequently. The reaction mixture was then heated to reflux for 6 hours. After cooling to room temperature, the mixture was extracted thrice with 500 mL ethyl acetate. The combined organic layers were washed with 500 mL brine and dried (Na2SO4). After removal of the solvent in vacuo, the crude product was purified using column chromatography (silica column, cyclohexane/ethyl acetate gradient). The product was isolated as pale yellow crystals (20.6 g, 0.106 mol, 56% yield).

Antioxidant 8: 3-ethyl-1,5-dimethyl-pyrazol-4-ol (2a)

A mixture of 1-(4-hydroxy-1,5-dimethyl-pyrazol-3-yl) ethenone (1a) (7.5 g, 48.6 mmol) and Raney nickel H0-50 (1.99 g) in 60 mL 1,4-dioxane was pressurized with hydrogen gas to 66 bar. After heating to 170° C. (100 bar pressure), stirring was continued for 3 hours. After depressurizing the reaction mixture was filtered and the filtrate was concentrated in vacuo. The crude product was purified using column chromatography (silica column, cyclohexane/ethyl acetate gradient). The product was isolated as a pale yellow solid (4.0 g, 28.5 mmol, 59% yield).

Antioxidant 9: 1-tert-butyl-3-ethyl-5-methyl-pyrazol-4-ol (2b)

2.5 g (12.8 mmol) of the slightly yellowish solid, 0.8 g Raney-Nickel und 60 ml dioxane were pressurized with hydrogen gas to 61 bar. After heating to 170° C. stirring was continued for 3 hours. After depressurizing the reaction mixture was filtered and the filtrate was concentrated in vacuo. The crude product was purified using column chromatography (silica column, cyclohexane/ethyl acetate gradient). The product was isolated as a pale yellow solid (1.5 g, 8.2 mmol).

LITERATURE

[1] "Reactions of Glyoxals with Hydrazones: A new Route to 4-Hydroxypyrazoles", M. Begtrup, H. P. Nytoft, J. Chem. Soc. Perkin Trans. 1985, 81-86.

[2] "Maximizing Lipophilic Efficiency: The use of Free-Wilson Analysis in the Design of Inhibitors of Acetyl-CoA Carboxylase", K. D. Freeman-Cook et al., J. Med. Chem. 2012, 55, 935-942.

Stability Tests

A silver and tin methanesulfonic acid solution comprising a complexing agent was prepared. 0.3 g/l Antioxidant was added to the solution. The solutions were filled into cuvettes for turbidity measurements. The sealed cuvettes were stored at 50° C. Turbidity was measured at regular intervals and the lids were regularly opened to allow for oxygen diffusion. Turbidity measurements were carried out at r.t. using a Hach TL2350 (Hach Lange GmbH). The silver and tin methanesulfonic acid solution without antioxidant served as reference.

If the turbidity was determined to exceed 4 NTU (NTU=nephelometric turbidity unit), the solution was considered to be unstable. If the tin silver methanesulfonic acid solution with antioxidant was stable for a longer time than the reference solution without antioxidant, this was an indication for a good antioxidant ("+"). If the tin silver methanesulfonic acid solution with antioxidant was as stable as the reference solution without antioxidant, this was an indication that the antioxidant did not act as such ("o"). If the tin silver methanesulfonic acid solution with antioxidant was less stable compared to the reference solution without antioxidant, this was an indication that the antioxidant acted as destabilizer ("−").

The antioxidants of example 1 were subjected to the test procedure described above. The results are listed in Table 1.

TABLE 1

| No. | Compound | Test Result |
|---|---|---|
| 1 | Antipyrine | + |
| 2 | 5-Pyrazolone | + |
| 3 | 1,3-dimethyl-1H-pyrazol-5-ol | + |
| 4 | 1-phenylpyrazolidine-3,5-dione | + |
| 5 | 2-tert-butyl-4,5-dimethyl-pyrazol-3-ol | + |
| 6 | 1-(4-hydroxy-1,5-dimethyl-pyrazol-3-yl)- | + |
| 7 | 1,5-dimethyl-3-phenyl-pyrazol-4-ol | + |
| 8 | 3-ethyl-1,5-dimethyl-pyrazol-4-ol | + |
| 9 | 1-tert-butyl-3-ethyl-5-methyl-pyrazol-4-ol | + |

The invention claimed is:

1. An aqueous composition for electrodepositing tin or tin alloys, the composition comprising tin ions, optionally alloy metal ions selected from the group consisting of silver, indium, and bismuth, and at least one antioxidant of formula X1a (X1a)

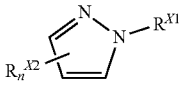

or of formula X1b (X1b)

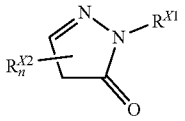

or of formula X1c (X1c)

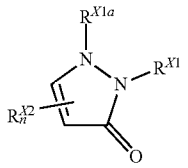

or of formula X1d (X1d)

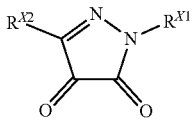

or of formula X1e (X1e)

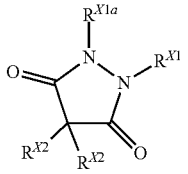

or the tautomeric forms of formulas X1a, X1b, X1c, X1d, and X1e, wherein $R^{X1}$, $R^{X1a}$ are independently selected from the group consisting of:

(a) H, (b) $C_1$ to $C_6$ alkyl, $C_1$ to $C_6$ alkenyl, $C_5$ to $C_{12}$ aryl, $C_6$ to $C_{15}$ alkylaryl, $C_6$ to $C_{15}$ arylalkyl, all of which are unsubstituted or substituted by OH, $OR^{X3}$, —CO—$R^{X3}$, —CO—$OR^{X3}$, —$SO_2$—$OR^{X3}$, CN, halogen, and a combination thereof, with the proviso that if the antioxidant is of formula X1b then $R^{X1}$ is not $C_5$ to $C_{12}$ aryl or $C_6$ to $C_{15}$ alkylaryl;

$R^{X2}$ is selected from the group consisting of:

(a) H, OH, $OR^{X3}$, —CO—$R^{X3}$, —CO—$OR^{X3}$, —$SO_2$—$OR^{X3}$, (b) $C_1$ to $C_6$ alkyl, $C_1$ to $C_6$ alkenyl, $C_5$ to $C_{12}$ aryl, $C_6$ to $C_{15}$ alkylaryl, $C_6$ to $C_{15}$ arylalkyl, all of which are unsubstituted or substituted by OH, $OR^{X3}$, —CO—$R^{X3}$, —CO—$OR^{X3}$, —$SO_2$—$OR^{X3}$, CN, halogen, and a combination thereof, wherein in formula X1a at least one of $R^{X2}$ is OH, and with the proviso that if in formula X1a $R^{X1}$ is t-butyl then $R^{X2}{}_2$ is not $C_5$ to $C_{12}$ aryl or substituted by —CO—$R^{X3}$;

$R^{X3}$ is H or $C_1$ to $C_6$ alkyl; and n is the number of groups $R^{X2}$;

wherein no further alloying metal ions are present in the composition besides the tin ions and the optional alloy metal ions selected from the group consisting of silver, indium, and bismuth; and wherein the composition does not comprise any reducing agents besides the compounds of formulas X1a to X1e.

2. The composition according to claim 1, wherein $R^{X1}$ is selected from the group consisting of (a) H, (b) $C_1$ to $C_6$ alkyl, phenyl, and $C_1$ to $C_4$ alkylphenyl, all of which are unsubstituted or substituted by —CO—$OR^{X3}$ or —$SO_2$—$OR^{X3}$.

3. The composition according to claim 1, wherein $R^{X2}$ is selected from the group consisting of H, OH, $OR^{X3}$, —CO—$R^{X3}$, —CO—$OR^{X3}$, —$SO_2$—$OR^{X3}$, $C_1$ to $C_4$ alkyl, phenyl, and $C_1$ to $C_4$ alkylphenyl, all of which are unsubstituted or substituted by OH, $OR^{X3}$, —CO—$R^{X3}$, —CO—$OR^{X3}$, or —$SO_2$—$OR^{X3}$.

4. The composition according to claim 1, wherein $R^{X2}$ is selected from the group consisting of H, OH, —CO—$R^{X3}$, methyl, ethyl, 1-propyl, 2-propyl, 1-butyl, 2 butyl, t-butyl, and phenyl, which may be unsubstituted or substituted by OH.

5. The composition according to claim 1, wherein at least one antioxidant is a compound of formula X1a.

6. The composition according to claim 5, wherein $R^{X1}$ is selected from the group consisting of a $C_1$ to $C_4$ alkyl and either $R^{X2}{}_1$ or $R^{X2}{}_2$ are OH and the other $R^{X2}{}_1$, $R^{X2}{}_1$, and $R^{X2}{}_1$ are H, methyl ethyl, propyl or butyl, or substituted by —CO—$R^{X3}$.

7. The composition according to claim 1, wherein the antioxidant is selected from the group consisting of antipyrine, 5-pyrazolone, 1,3-dimethyl-1H-pyrazol-5-ol, 1-phenylpyrazolidine-3,5-dione, 2-tert-butyl-4,5-dimethyl-pyrazol-3-ol, 1-(4-hydroxy-1,5-dimethyl-pyrazol-3-yl)-ethanone, 1,5-dimethyl-3-phenyl-pyrazol-4-ol, 3-ethyl-1,5-dimethyl-pyrazol-4-ol, and 1-tert-butyl-3-ethyl-5-methyl-pyrazol-4-ol.

8. The composition according to claim 1, comprising the alloy metal ions, wherein the alloy metal ions comprise silver ions.

9. The composition according to claim 1, wherein the pH of the composition is below 4.

10. The composition according to claim 1, further comprising a further additive selected from the group consisting of one or more surfactants, one or more levelers, and one or more grain refiners.

11. The composition according to claim 1, wherein the only alloy metal ions consists of silver ions.

12. The composition according to claim 1, wherein the pH of the composition is below 3.

13. The composition according to claim 1, wherein the pH of the composition is below 2.

14. A process for depositing a tin or tin alloy layer on a substrate comprising the steps of:

a) contacting a tin or tin alloy electroplating bath comprising the composition according to claim 1 with the substrate, and b) applying a current density to the substrate for a time sufficient to deposit the tin or tin alloy layer onto the substrate.

15. The process according to claim 14, wherein the tin alloy layer is deposited, and a alloy metal content of the deposited tin alloy layer is in a range of from 0.01 to 10% by weight.

16. The process according to claim 14, wherein the substrate comprises recessed features having an aperture size in a range of from 1 to 1000 micrometers, and the deposition is performed to at least partially fill the micrometer sized recessed features.

17. The process according to claim 14, wherein the substrate comprises recessed features having an aperture size in a range of from 1 to 200 micrometers and the deposition is performed to at least partially fill the micrometer sized recessed features.

18. The process according to claim 14, wherein the substrate comprises recessed features having an aperture size in a range of from 3 to 100 micrometers, and the deposition is performed to at least partially fill the micrometer sized recessed features.

* * * * *